US005632310A

United States Patent [19]

Yasuoka

[11] Patent Number: 5,632,310

[45] Date of Patent: May 27, 1997

[54] SINGLE LAYER WOVEN FABRIC FOR PAPER-MAKING

[75] Inventor: Tatsuhiko Yasuoka, Tokyo, Japan

[73] Assignee: Nippon Filcon Co., Ltd., Tokyo, Japan

[21] Appl. No.: 566,851

[22] Filed: Dec. 4, 1995

[30] Foreign Application Priority Data

Dec. 1, 1994 [JP] Japan ..... 6-332277

[51] Int. Cl.[6] ..... D03D 23/00

[52] U.S. Cl. ..... 139/383 A; 442/203; 442/215; 442/216

[58] Field of Search ..... 139/383 A; 428/225, 428/257

[56] References Cited

U.S. PATENT DOCUMENTS 5,487,414 1/1996 Huji et al. ..... 139/383 A
5,518,042 5/1996 Wilson ..... 139/383 A

FOREIGN PATENT DOCUMENTS 0345643 12/1989 Japan .
2200885 8/1990 Japan .

*Primary Examiner*—James J. Bell
*Attorney, Agent, or Firm*—Foley & Lardner

[57] ABSTRACT

A single layer woven fabric for paper-making, in which at least a pair of two successive knuckles in the paper-making side at an interval of one warp, and at least one crimp in the running side form a plain weave structure. The knuckle be formed by allowing a weft to pass over one warp, to pass under one adjacent warp, and then to pass over the one warp. The crimp be formed by allowing a weft to pass under not less than three successive warps. The plain weave structure is formed by binding two or three wefts constituting a group which in turn constitutes a repeating unit and by placing the combined group, in the direction of wefts, so that the knuckles of wefts in the paper-making side are placed successively at an interval of one warp. The placement of the wefts group is made by shifting the group as the whole successively by a distance corresponding to an odd number of the warp.

12 Claims, 5 Drawing Sheets

SINGLE LAYER WOVEN FABRIC FOR PAPER-MAKING

BACKGROUND OF THE INVENTION

The present invention relates to a woven fabric for paper-making. Conventionally, there are many requirements for woven fabrics for paper-making. The requirements include, for example:

(1) Prevention of wire marks formation and improvement of paper-making retention by enhancing the surface smoothness and improvement of a stock's property for supporting fiber;

(2) Extension of service life of woven fabric and improvement of running property by enhancing the abrasion resistance; and (3) Improvement of stiffness, stable attitude and dimension stability, excellent water drainage; and ensuring low water holding property. These requirements are correlated mutually and, in principle, the properties are not independent. However, roughly speaking, the requirement (1) relates mainly to the paper-making face side of woven fabric; the requirement (2) relates mainly to the running face side of woven fabric; and the requirement (3) relates mainly to the whole structure of woven fabric.

Many proposals have been made heretofore for responding to the mentioned requirements. However, satisfactory methods have not been found yet. For example, fine weaving using fine yarn might be a solution for settling the requirement (1) to form a smooth paper-making face; however, such woven fabric is unsatisfactory for abrasion resistance of requirement (2) and stiffness and stable attitude of requirement (3).

Recently, some trials for improving a stock's property for supporting fiber have been made from the standpoint of fabric structure including forming the paper-making face with wefts. The formation of the paper-making face with wefts improves water drainage as well since the water drainage space existing among warps is not blocked by the fibers of the stock. More specifically, for example, auxiliary wefts are placed adjacent to the original wefts. This method has been practiced for single and double woven fabrics; however, the results cannot be said to be sufficiently satisfactory.

On the other hand, as for the enhancement of abrasion resistance requirement (2), the prevention of wear of warps has been practiced conventionally as a type of weft abrasion in which the running face of the paper-making woven fabric is formed by wefts. Generally, the function of wear-resistance is preferred to be borne by the wefts in view of extension of the service life of a woven fabric in use, attitude (shape) and dimensional stability as well. When the warp is worn, it is a matter of course that the tensile strength is lowered and the dimension of the woven fabric is elongated. When the abrasion continues, the woven fabric cannot bear the tension and then breaks and the service life is over. From the standpoint of yarn material, polyamide yarn is used for the running face side yarn since polyamide yarn is more wear-resistant than polyester. However, this is just a matter of material performance and cannot bring about a drastic effect. Use of polyamide yarn, on the other hand, is disadvantageous in that the stiffness and stable attitude of the requirement (3) are deteriorated. Thus, polyamide yarn and polyester yarn are use alternatively at most.

Trials to use yarn of large diameter for the running face weft have been made and some improvement has been made thereby. However, the balance between the weft and warp cannot be kept, and crimping property is worsened. As a result, the prevention of wire marks of the requirement (1) cannot be realized. Hence, the trials have been problematic in practice.

As explained above, the requirements (1) through (3) are contradictory in some aspects. For example, a trial to overcome the requirement (1) contradicts the requirement (2). In this regard, trials to overcome these problems with upper and lower two layered woven fabric have been made in which different warps and different wefts are used in the paper-making face side and running face side respectively, and the woven fabrics of both layers are integrated by binding yarn. That is, the paper-making face is formed by using warp and weft of smaller size to make the paper-making face side woven fabric smooth, and the running face is formed by using warp and weft of larger size to make the running face of greater wear-resistance.

However, the results have not been completely satisfactory. That is, the binding yarn pulls the woven fabric at the paper-making face side into the running face side at the connection part where the binding yarn crosses the warp or weft, and concave parts are generated on the woven fabric surface at the paper-making face side. The concave parts cause wire marks as if transcribing on to a sheet of paper. More recently, trials to improve the wear-resistance, in double weft woven fabric, have been made by enlarging the wear-resistant volume. In that case, shafts of 14 or 16, which are twice as large as usual shafts, are used, and crimps twice as long as the usual ones are formed in the lower weft. The results are good. However, still there remains unsatisfactory performance in many respects including the surface smoothness of the requirement (1) and stiffness and water holding property of the requirement (3).

The solution for the requirement (2) for paper-making woven fabric is now very important since the need for high speed paper-making, increased filler amount, and neutral paper is becoming more urgent. In addition, even though use of paper-making woven fabric of multiple weave has increased and high speed paper-making has progressed, these have brought new problems. Woven fabric of multiple weave attains stiffness, stable attitude, and wear-resistance that cannot be realized by single layer woven fabric; however, its structure makes the water holding increased. Thus, water contained in the woven fabric is sprayed as water drops at the returning part by centrifugal force with high speed rotation, and the water drops fall on wet paper causing marks on the paper.

Paper-making woven fabrics of single weave do not cause such a problem since they retain small amount of water. However, conventional paper-making woven fabrics of single weave normally form the running face having long crimps of weft for the purpose of maintaining wear-resistance. Hence, long crimps of warp are placed in parallel in the paper-making face side in a paper-making woven fabric of single weave; knuckles of the weft protrude therebetween. When paper stock is fed to a running paper-making woven fabric, the stock fibers are oriented inevitably to the running direction and deposited among the long crimps of warp. When the fibers are blocked, the space for filtrate water passes is blocked. Since the filtrate water is blocked in this way, more vacuum is required for dehydrating for the compensation; as a result wire marks are formed.

SUMMARY OF THE INVENTION

In view of the problems as explained above associated with conventional technologies, the present invention is to provide a paper-making woven fabric which is a single layer woven fabric retaining a small amount of water, having a smooth surface, the ability to hold stock excellently, having good other properties for paper-making such as water drainage, and having improved wear-resistance. That is, the present invention is to satisfy all the requirements (1) through (3), which are mutually contradictory.

The present invention relates to a single layer woven fabric for paper-making comprising: a paper-making side and a running side and having a repeating units formed by wefts and warps; wherein each of the wefts forms, in the repeating unit, two first and third knuckles on the paper-making side and one second knuckle on the running side by passing over a first warp, passing under a second warp and passing over a third warp, the first warp being adjacent to the second warp and the second warp being adjacent to the third warp, and forms one crimp on the running side by passing under three or more warps; wherein said wefts form a group of two or three successive wefts which comprises a plain weave structure; and further wherein each of the groups is arranged by shifting for the distance corresponding to an odd number of the warps from an adjacent group. Each weft of the group may be a weft which forms the plain weave structure by way of the knuckles formed on the paper-making side by the weft and the first and the third warps. One weft in the group can form the long crimp on the running side at the knuckle on the paper-making side formed by the other weft in the group. The warp can be either polyester monofilament or polyphenylene sulfide monofilament and the weft can be one or more selected from polyester monofilament, polyamide monofilament and polyphenylene sulfide monofilaments.

Another feature of the present invention relates to a single layer woven fabric for paper-making comprising: a paper-making side and a running side and having a repeating units formed by wefts and warps; wherein a first weft forms, in the repeating unit, one knuckle on the paper-making side by passing over one of the warps and one crimp on the running side by passing under the rest of the warps, and a second weft forms, in the repeating unit, two first and third knuckles on the paper-making side and one second knuckle on the running side by passing over a first warp, passing under a second warp and passing over a third warp, wherein the first warp is adjacent to the second warp and the second warp is adjacent to the third warp, and forms one crimp on the running side by passing under three or more warps; wherein the first weft and the second weft arranged adjacent to the first weft form a group which comprises a plain weave structure; and further wherein each of the groups is arranged by shifting in the distance corresponding to an odd number of the warps from an adjacent group.

For the case of woven fabrics for paper-making, it is ideal to form the paper-making face side with plain weave texture. Plain weave texture is the texture in which each weft and each warp are alternatively crossed; hence, number of the knuckles of warp and weft that support the stock fiber is largest among weave textures. Arrangement of the knuckles in the same plane and at the same level produces product paper that has a flat and smooth surface.

However, a single woven fabric of plain weave texture makes the running face also plain weave texture; hence, the warp is soon worn. The abrasion resistance is thus problematic. The woven fabric, having upper and lower two layers that uses plain weave texture for the woven fabric of paper-making face side and uses an abrasion resistant texture, has also problems of the concavity of the connecting part and excessive water holding. According to the present invention, the paper-making face side is formed like plain weave, and the running face is formed with long crimps of weft; thereby, the problems mentioned above have been overcome.

PREFERRED EMBODIMENT OF THE INVENTION

Figure 1:
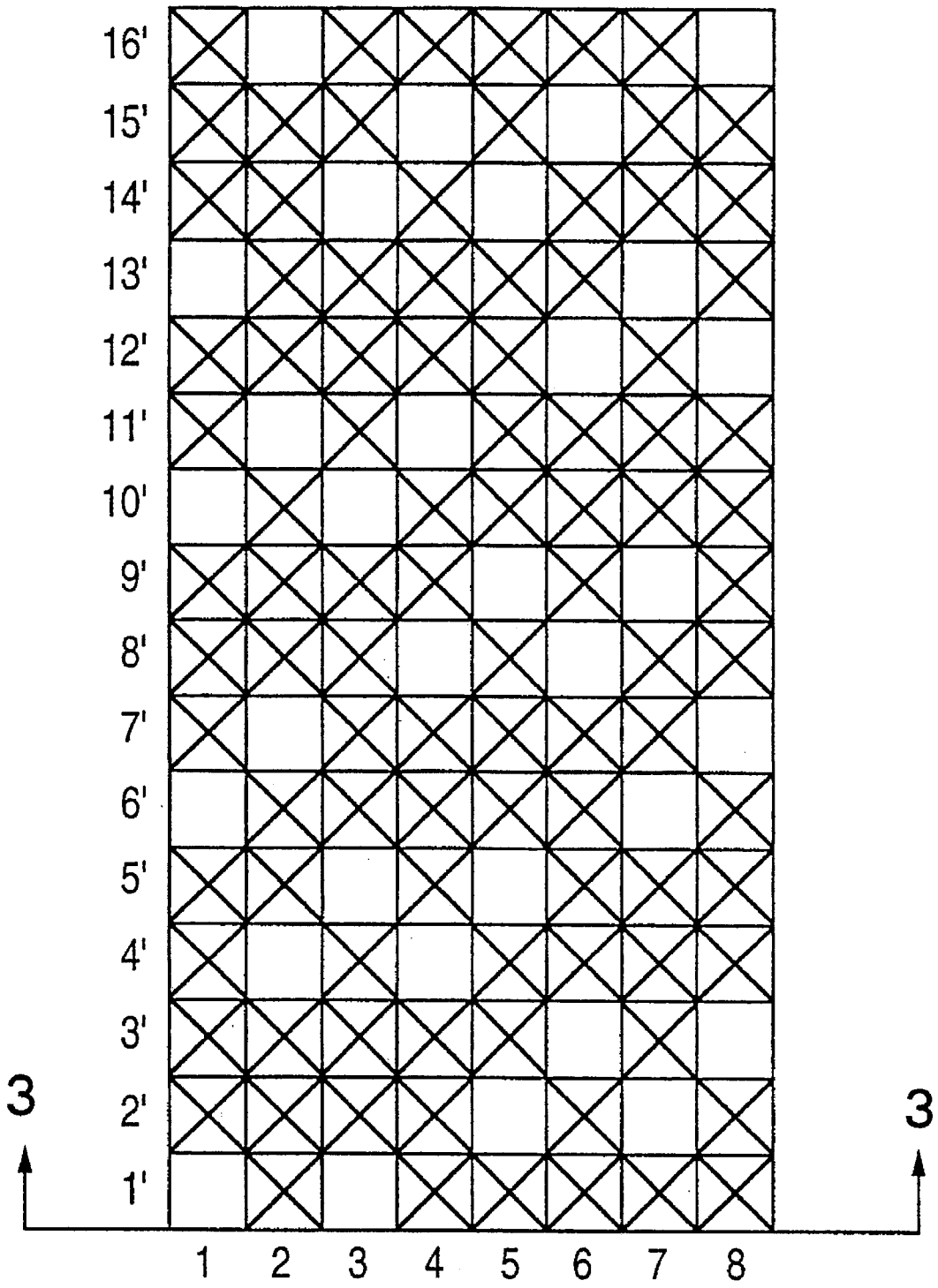
FIG. 1 is a diagram illustrating the complete design of the present invention.

A characteristic of the present invention is that a plain weave structure using wefts that appear as if consisting of one weft is formed on the paper-making side with a group of wefts in which two or three adjacent wefts are combined. The plain weave structure using wefts apparently consisting of one weft is formed using the knuckles, on the paper-making side, of the groups of two or three wefts; hence, respective wefts comprising the group are not necessary required to pertain to the formation of plain weave in the whole parts; and the parts that do not form the knuckles on the paper-making side, not pertaining to the formation of plain weave, are able to be subjected to form long crimps protruding to the running face. In this way, in a portion in which one weft pertains to the formation of plain weave structure, the other weft in the same wefts group forms long crimps in the running face; in a portion in which one weft pertains to the formation of plain weave structure, the other weft in the same wefts group forms knuckles in the paper-making side pertaining to the formation of plain weave structure. By placing the wefts groups shifted as the group by an odd number of warp, paper-making side knuckles are formed the same as the plain weave structure; thus, a paper-making face the same as a plain weave structure is obtained.

On the other hand, long crimps, which take part in the abrasion resistance, are formed in the running face. Since no binding yarn is used, the paper-making face formed is flat and smooth without concavity. Another characteristic of the present invention is that the woven fabric is a single woven fabric having one layer of warp and weft. Because of the single woven fabric, the water holding property is not excessive as is the case of multiple woven fabric; the water holding property is surely low, and the product is of light weight and has good water holding property.

How the two or three wefts in a group are placed adjacently and why the knuckles in the paper-making side are formed nearly linearly as if a plain weave is explained below. Generally, when two pieces of yarn exist, the two pieces are adjacent in parallel when the knuckles formed by the yarn are identical having the same structure. However, when the structure differs or the location is shifted, repulsion force, by which the two pieces of yarn tend to separate, is larger as the distance between each yarn is shorter and as the number of knuckles increases.

The relationship between the adjacent wefts in the present invention is this: the distance between the knuckles in the paper-making side corresponds to the width of one warp for the wefts in the same group; and the distance between the knuckles in the paper-making side corresponds to the width of zero warp for the wefts in the same group in different groups. Hence, when strong repulsion force is applied by the wefts of different groups, knuckles on the paper-making side are pushed on to long crimps of the same group weft and overlapped somewhat on the long crimps. Consequently, the knuckles in the paper-making side of the same group weft are formed nearly linearly as a plain weave structure.

According to the present invention, not more than three knuckles, in which one weft is continuous crossing one warp, are formed in the paper-making side; the reason is as follows. For example, suppose three knuckles are formed continuously in the paper-making side; then, in both sides of the center knuckle in the paper-making side, knuckles in the paper-making side are formed crossing one warp; in contrast, the two knuckles in the paper-making side of both ends are formed, one side forming a paper-making side knuckle crossing one warp and the other side forming a long crimp; thereby the two knuckles in the paper-making side has the same height and shape since they are subjected to the same influence, however, the center knuckle in the paper-making side has different height and shape since the influence differs; and the difference in the knuckles develops as concave and convex in the paper-making face causing wire marks. Hence, not more than three knuckles in the paper-making side should not be formed.

In the present invention, the warp used is either polyester monofilament or polyphenylene sulfide and the weft used is one or more selected from polyester monofilament, polyamide monofilament and polyphenylene sulfide monofilament.

EXAMPLES

Now, the present invention is explained in more details by referring to the drawings.

FIG. 1 is a diagram illustrating the complete design of a repeating unit according to an example of the present invention. In this diagram, mark "X" indicates that the warp crosses over the weft, no mark indicates that the warp crosses under the weft, and thereby the knuckle of the weft is shown in the present invention. The warps are indicated by the reference numerals with apostrophe (') and the wefts are indicated by the reference numerals without apostrophe. Weft 1' forms a knuckle in the paper-making side passing over warp 1, passes under warp 2 forming second knuckle in the paper-making side, thereafter passes under successive warps 4, 5, 6, 7 and 8 forming a long crimp in the running side for the five warps, and thereby constitutes a repeating unit for eight warps. Weft 2' forms a structure which corresponds to what is shifted of weft 1' with a distance for four warps forming two knuckles at the positions of warps 5 and 7, and passes under warp 8 and warps 1, 2, 3 and 4 of next complete design forming a long crimp in the running side for the five warps. In this example, weft 1' and weft 2' constitutes one wefts group with the two wefts; when this group is combined with the paper-making side knuckle of weft 1' and the paper-making side knuckle of weft 2, knuckles in the paper-making side are formed at the positions of wefts 1, 3, 5 and 7. In this way, knuckles in the paper-making side are successively formed at an interval of one warp. This wefts group is shifted, as the whole group, by the distance corresponding to five warps; successive groups are placed forming complete designs in the way of a group of wefts 3' and 4', group of wefts 5' and 6', group of wefts 7' and 8', group of wefts 9' and 10', group of wefts 11' and 12', group of wefts 13' and 14' and group of wefts 15' and 16'.

As explained above, the successive knuckles in the paper-making side for one warp are placed by being shifted as the group by the odd number of five of the warps; hence, the paper-making side is formed as if in a way where the weft crosses the warps at an interval of one warp.

Figure 2:
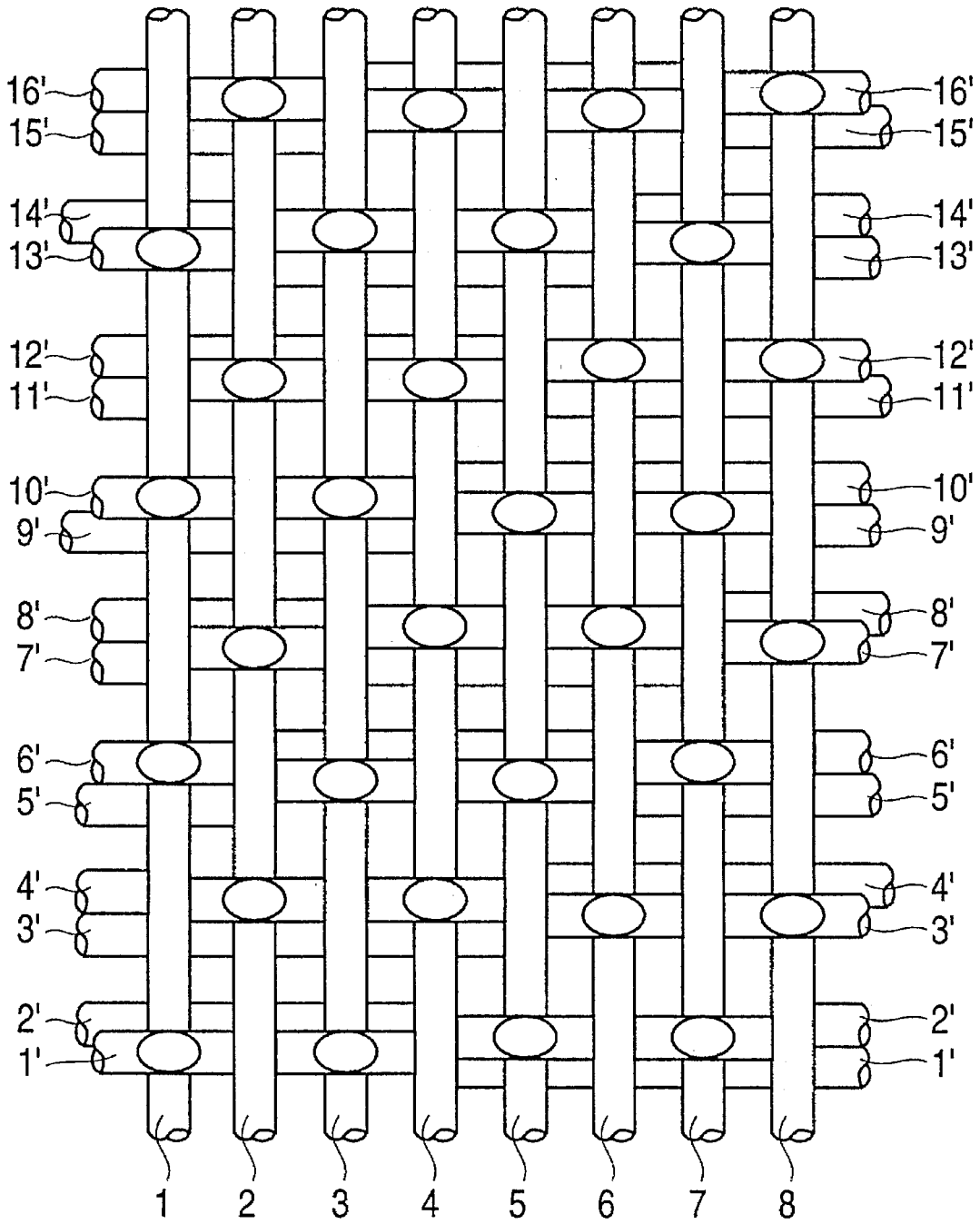
FIG. 2 is a plan view, from the paper-making side, of the example shown by FIG. 1.

FIG. 2 is a plan view, from the paper-making side, of the example shown by FIG. 1. For ease of understanding, oval marks are incorporated in the top portions of the knuckles in the paper-making side of the wefts. From this plan view, the formation of adjacent groups of wefts 1' and 2'; wefts 3' and 4'; . . . ; and wefts 15' and 16' are seen aligning nearly in straight at an interval of one warp. In FIG. 2, the group of weft 1' and 2' is separated from the group of weft 3' and 4'; the wefts in each group are placed in overlap to some extent; and some shift in the superimpose is seen between the knuckle portion, over warp 4, of wefts 1' and 2', and the long crimp portion, under the warp, of wefts 1' and 2'.

Figure 3:
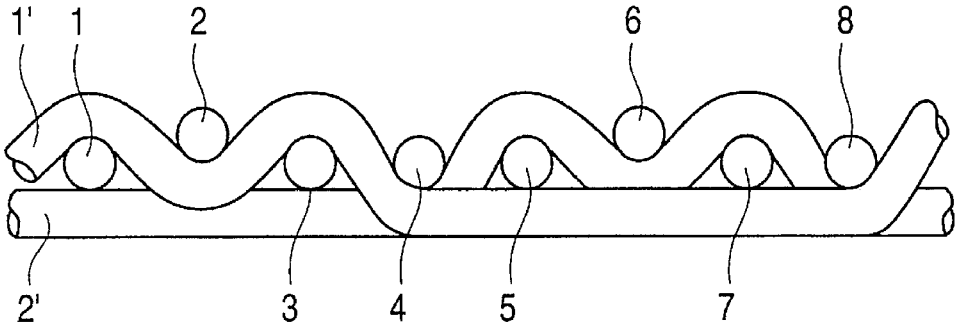
FIG. 3 is a cross-section view, along line 3—3 of FIG. 1.

FIG. 3 is a cross-section view, along 3—3 of FIG. 1, of wefts 1' and 2' that forms a group seen from the side of weft 1'. As shown, weft 2' forms a long crimp in the running face in the portion where weft 1' forms a knuckle in the paper-making side, and weft 1' forms a long crimp in the running face in the portion where weft 2' forms a knuckle in the paper-making side; the long crimp in the running side protrudes to the running side than the weft whereby the long crimp protects the weft.

Figure 4:
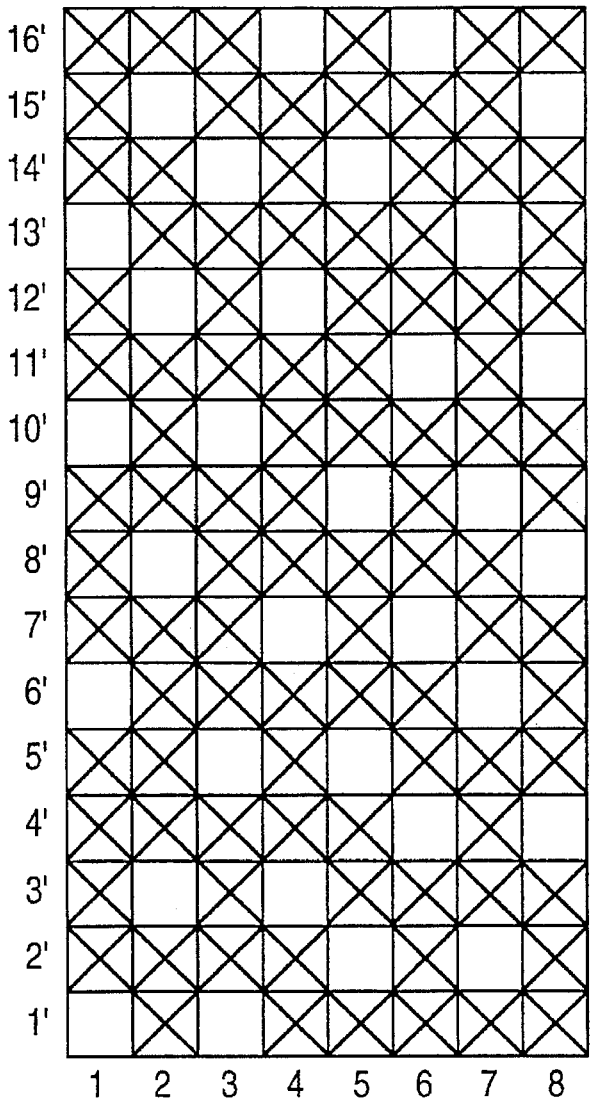
FIG. 4 is a diagram illustrating the complete design of a repeating unit of the present invention.

FIG. 4 is a diagram illustrating the complete design of a repeating unit according to another example of the present invention. In this example, eight warps constitute a repeating unit for the weft, as is the case of the example shown by FIGS. 1 to 3, the knuckle in the paper-making side is formed twice and a long crimp for the five warps is formed as in the previous example. The group of wefts consists of two wefts. This is understood because the structure of wefts 1' and 2' is quite the same as the previous example. What is different from the previous example is how the wefts group shifts. In the previous example, the shift corresponds to five warps; in the present example, the complete design is constituted by the shift corresponding to one warp, in contrast. The shift may correspond to any odd numbers of the warps since the knuckles in the paper-making side is satisfactory as long as the knuckles are placed as if in a plain weave.

Figure 5:
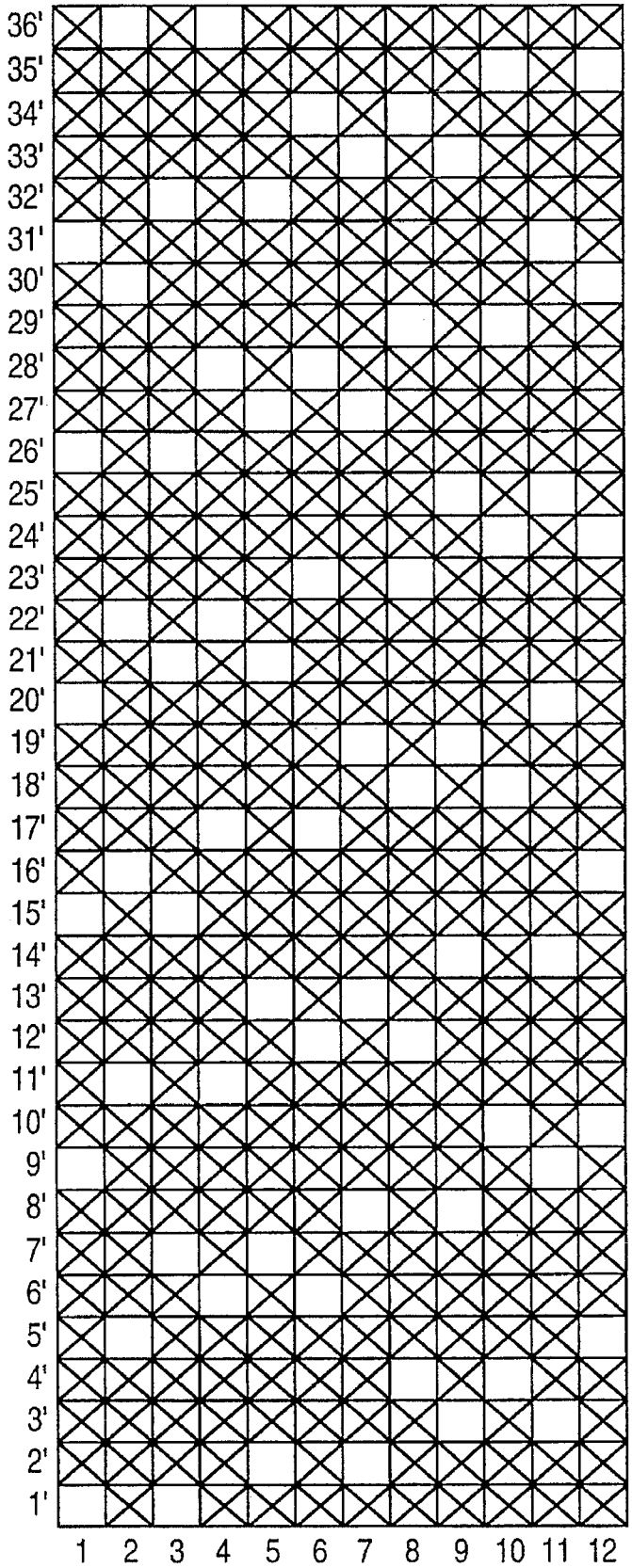
FIG. 5 is a diagram illustrating the complete design of a repeating unit of the present invention.

FIG. 5 is a diagram illustrating the complete design of a repeating unit according to another example of the present invention. In this example, the group consists of three wefts forming constituting the repeating unit for twelve warps; the complete structure is composed with the shift corresponding to seven warps. Weft 1' passes over warp 1 forming the knuckles in the paper-making side, passes under warp 2, passes over warp 3 forming a second knuckle in the paper-making side, and passes under successive warps 4, 5, 6, 7, 8, 9, 10, 11 and 12 forming a long crimp for nine warps. Weft 2' is structured so that weft 1' is shifted by the distance corresponding to four warps, and weft 3' is structured so as to be further shifted by the distance corresponding to four warps; thereby, two knuckles in the paper-making side are formed, in the same way as weft 1', a long crimp in the running side is former for the parts of warp 1, 3, 5, 7, 9 and 11, and the knuckles in the paper-making side are formed successively at an interval of one warp. The group consisting of three wefts is shifted as the whole group by the distance corresponding to seven warps; thereby, a group of wefts 4', 5' and 6', group of wefts 7', 8' and 9', . . . , and group of wefts 34', 35' and 36' are placed successively forming a complete design.

Figure 6:
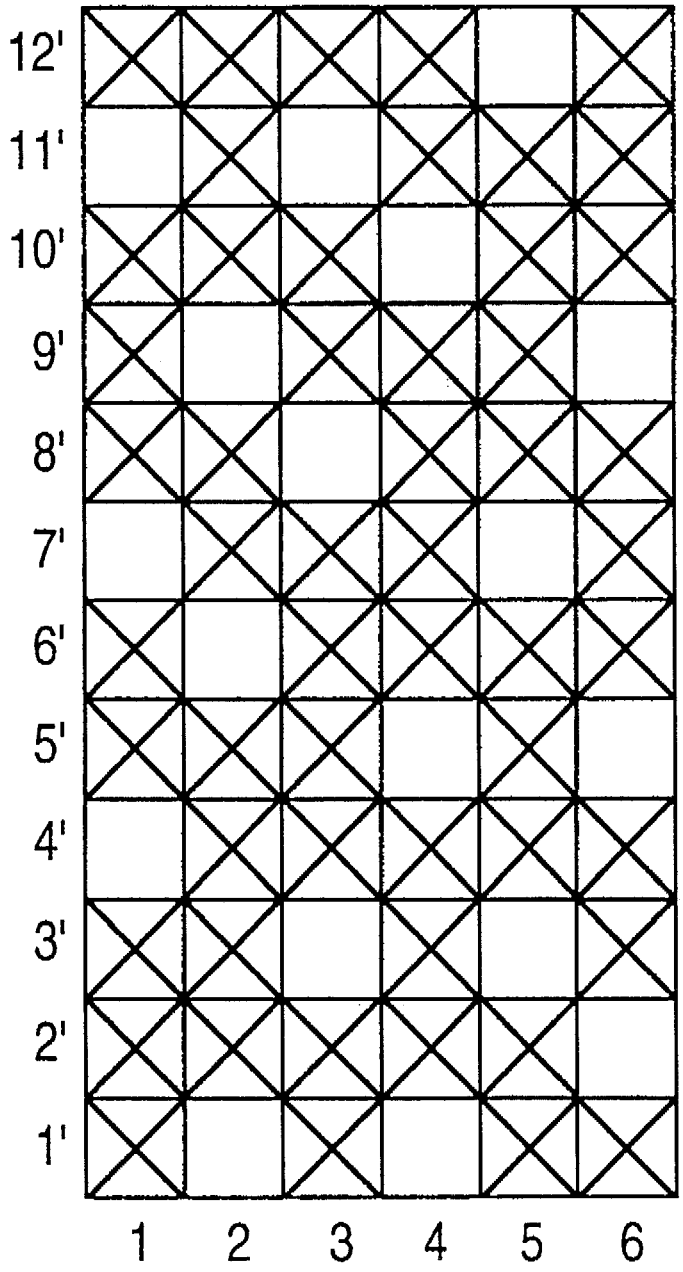
FIG. 6 is a diagram illustrating the complete design of a repeating unit of the present invention.

FIG. 6 is a diagram illustrating the complete design of a repeating unit according to still another example of the present invention. In this example, the group consists of three wefts constituting the repeating unit for six warps; the complete structure is composed with the shift corresponding to seven warps. Weft 1' passes over warp 2 forming the knuckles in the paper-making side, passes under warp 3, passes over warp 4 forming a second knuckle in the paper-making side, and passes under successive warps 5 and 6 and adjacent warp 1 of the complete design drawing forming a long crimp for three warps. Weft 2' has a structure different from warp 1', passes under successive warps 1, 2, 3, 4 and 5 to form a long crimp for the five wefts, and passes over warp 6 to form one knuckle in the paper-making side. Wefts 1' and 2' form a group of wefts; when the knuckle of weft 1' and 2' in the paper-making side is combined, knuckles in the paper-making side are successively formed at an interval of one warp.

The group consisting of two wefts is shifted as the whole group by the distance corresponding to one warp; thereby, a group of wefts 3' and 4', group of wefts 5' and 6', group of wefts 7' and 8', group of wefts 9' and 10', and group of wefts 11' and 12' are placed successively forming a complete design.

As shown, the present invention is able to provide a paper-making woven fabric in which the paper-making side is formed, with a single woven fabric, nearly the same way as a plain weave; the running side is able to be formed with long crimps of the wefts; the water holding property is small and excellent; and the surface is smooth and of large abrasion resistance.

The following comparative tests show the above fact more specifically.

Comparative Test

Example 1 is selected as a representative example of the present invention; a paper-making woven fabric of 3/1 satin weave texture, which has been often used conventionally, is selected as Comparative Example 1; and a woven fabric of single layer warps and double layers wefts of eight shafts is selected as Comparative Example 2. A comparative test was made for them. Table 1 shows the result. The compositions of woven fabric are also shown in Table 1.

TABLE 1

| | | | Ex. 1 | Cmp. Ex. 2 | Cmp. Ex. 3 |
|---|---|---|---|---|---|
| Woven Fabric Composition | Warp | Material | PET MF | PET MF | PET MF |
| | | Diameter (mm) | 0.17 | 0.17 | 0.17 |
| | | Density (number/inch) | 75 | 85 | 155 |
| | Upper Weft | Material | PET MF | PET MF | PET MF |
| | | Diameter (mm) | 0.19 | 0.22 | 0.17 |
| | | Density (number/(inch) | 120 | 60 | 55 |
| | Lower Weft | Material | — | — | PET MF |
| | | Diameter (mm) | — | — | 0.25 |
| | | Density (number/inch) | — | — | 55 |
| Period for filtering pulp liquid (sec.)*1 | | | 57 | 6.2 | 7.3 |
| Sheet Smoothness (sec.)*2 | | | 92 | 74 | 85 |
| Life Number Ratio*3 | | | 100 | 72 | 86 |

Ex: Example
Cmp: Comparative
Mf: Monofilament
(Note)
*1Drainage time of pulp liquid (sec.): A newspaper broke (pulp) is desegregated and made into a sample that has freeness of 170 ml and has water level of 300 mm. The sample pulp liquid is allowed to flow down at an angle of 15 degrees against the perpendicularity of the woven fabric surface. The period of time (seconds) is measured until the water level turns to zero.
*2Sheet smoothness: Smoothness (seconds) of the woven fabric side of paper sheet by a Bekk smoothness tester.
*3Life number ratio: Tested by an abrasion resistance tester made by Nippon Filcon KK (registered utility model No. 1350124).

As is clear from the example and comparison test result, the woven fabric for paper-making according to the present invention resulted in far greater excellence compared with conventional product examples in terms of the water drainage, sheet smoothness and abrasion resistance.

The woven fabric according to the present invention is constituted with the formation of plain weave structure (texture) in the paper-making side and the formation of long crimps in the running side; thereby, long lengthwise channels among wefts of conventional single layer woven fabric do not exist, piles of fiber in such channels does not occur, dehydration does not deteriorate as explained before, and excellent dehydration is maintained from the initial step of paper-making to transference to the next step of pressing without the necessity of compulsory vacuum dehydration. Consequently, abrasion of the woven fabric is small and the service life is extended. A plain weave structure has a most number of warps and wefts knuckles that support stock fiber; the warps and wefts knuckles are placed uniformly in the same plain at the same level making the surface flat and smooth. In this way, the paper quality and smoothness are improved, and the formation of wire marks is effectively prevented. Since these have been realized in the woven fabric structure of single layer weave, there are no difficulties associated with multiple layer weaves, in maintaining excellent water drainage small water holding property, and no problem occurs of dispersion of droplets of the water contained in the woven fabric. In this way, the present invention products excellent effects in that all the requirements (1), (2) and (3) for paper-making woven fabrics mentioned before are satisfied.

What is claimed is:

1. A single layer woven fabric for paper-making comprising: a paper-making side and a running side and having a repeating units formed by wefts and warps; wherein each of the wefts forms, in the repeating unit, two first and third knuckles on the paper-making side and one second knuckle on the running side by passing over a first warp, passing under a second warp and passing over a third warp, the first warp being adjacent to the second warp and the second warp being adjacent to the third warp, and forms one crimp on the running side bypassing under three or more warps; wherein said wefts form a group of two or three successive wefts which comprises a plain weave structure; and further wherein each of the groups is arranged by shifting for the distance corresponding to an odd number of the warps from an adjacent group.

2. A single layer woven fabric for paper-making according to claim 1, wherein each weft of the group is a weft which forms the plain weave structure by way of the knuckles formed on the paper-making side by the weft and the first and the third warps.

3. A single layer woven fabric for paper-making according to claim 1, wherein one weft in the group forms the long crimp on the running side at the knuckle on the paper-making side formed by the other weft in the group.

4. A single layer woven fabric for paper-making according to claim 2, wherein one weft in the group forms the long crimp on the running side at the knuckle on the paper-making side formed by the other weft in the group.

5. A single layer woven fabric for paper-making according to claim 1, wherein the warp is either polyester monofilament or polyphenylene sulfide monofilament and the weft is a member selected from the group consisting of polyester monofilament, polyamide monofilament, polyphenylene sulfide monofilaments and mixture.

6. A single layer woven fabric for paper-making according to claim 2, wherein the warp is either polyester monofilament or polyphenylene sulfide monofilament and the weft is a member selected from the group consisting of polyester monofilament, polyamide monofilament, polyphenylene sulfide monofilaments and mixtures.

7. A single layer woven fabric for paper-making according to claim 3, wherein the warp is either polyester monofilament or polyphenylene sulfide monofilament and the weft is a member selected from the group consisting of polyester monofilament, polyamide monofilament, polyphenylene sulfide monofilaments and mixtures.

8. A single layer woven fabric for paper-making according to claim 4, wherein the warp is either polyester monofilament or polyphenylene sulfide monofilament and the weft is a member selected from the group consisting of polyester monofilament, polyamide monofilament, polyphenylene sulfide monofilaments and mixtures.

9. A single layer woven fabric for paper-making comprising: a paper-making side and a running side and having a repeating units formed by wefts and warps; wherein a first weft forms, in the repeating unit, one knuckle on the paper-making side by passing over one of the warps and one crimp on the running side by passing under the rest of the warps, and a second weft forms, in the repeating unit, two first and third knuckles on the paper-making side and one second knuckle on the running side by passing over a first warp, passing under a second warp and passing over a third warp, wherein the first warp is adjacent to the second warp and the second warp is adjacent to the third warp, and forms one crimp on the running side by passing under three or more warps; wherein the first weft and the second weft arranged adjacent to the first weft form a group which comprises a plain weave structure; and further wherein each of the groups is arranged by shifting in the distance corresponding to an odd number of the warps from an adjacent group.

10. A single layer woven fabric for paper-making according to claim 9, the second weft of the group is a weft which forms the plain weave structure by way of the knuckles formed on the paper-making side by the weft and the first and the third warps.

11. A single layer woven fabric for paper-making according to claim 9, wherein either the first or second weft in the group forms the long crimp on the running side at the knuckle on the paper-making side formed by either the second or first weft in the group.

12. A single layer woven fabric for paper-making according to claim 9, wherein the warp is either polyester monofilament or polyphenylene sulfide monofilament and the weft is a member selected from the group consisting of polyester monofilament, polyamide monofilament, polyphenylene sulfide monofilaments and mixtures.

* * * * *